United States Patent [19]

Dalebout

[11] Patent Number: 4,850,585

[45] Date of Patent: Jul. 25, 1989

[54] STRIDING EXERCISER

[75] Inventor: William T. Dalebout, Logan, Utah

[73] Assignee: Weslo, Inc., Salt Lake City, Utah

[21] Appl. No.: 93,778

[22] Filed: Sep. 8, 1987

[51] Int. Cl.[4] ..... A63B 20/04

[52] U.S. Cl. ..... 272/70; 272/132

[58] Field of Search ..... 272/73, 97, 70, 131, 272/132, 134, 144, 145

[56] References Cited

U.S. PATENT DOCUMENTS

| | | | |
|---|---|---|---|
| 3,566,861 | 3/1971 | Weiss | 272/70 |
| 3,580,569 | 5/1971 | Wilson | 272/703 |
| 3,756,595 | 9/1973 | Hague | 272/70 |
| 3,759,511 | 9/1973 | Zinkin et al. | 272/70 |
| 3,784,194 | 1/1974 | Perrine . | |
| 4,226,415 | 10/1980 | Wright | 272/130 |
| 4,451,033 | 5/1984 | Nestegard | 272/73 |
| 4,456,247 | 6/1984 | Ehrenfried | 272/126 |
| 4,478,411 | 10/1984 | Baldwin | 272/118 |
| 4,529,194 | 7/1985 | Haaheim | 272/97 |
| 4,550,908 | 11/1985 | Dixon | 272/130 |
| 4,566,693 | 1/1986 | Seidentop et al. | 272/144 |
| 4,611,807 | 9/1986 | Castillo | 272/132 |
| 4,632,385 | 12/1986 | Geraci | 272/70 |
| 4,645,200 | 2/1987 | Hix | 272/70 |

FOREIGN PATENT DOCUMENTS

| | | | |
|---|---|---|---|
| 3209353 | 9/1983 | Fed. Rep. of Germany | 272/144 |
| 2537007 | 6/1984 | France | 272/134 |

OTHER PUBLICATIONS

Photos marked A, B and C, sketch D.

*Primary Examiner*—Richard J. Apley
*Assistant Examiner*—J. Welsh
*Attorney, Agent, or Firm*—Trask, Britt & Rossa

[57] ABSTRACT

An exercise apparatus is provided having a frame for supporting a user mounted on the apparatus above a support surface such as a floor. A pair of leg members and associated foot supports depend from and rotatably associate with a pair of journals connected to the frame. A user stands on the foot supports and moves his legs in a striding-type reciprocating motion. A pair of handle members may also be associated with the journals to rotate simultaneously with their respective leg members. A reciprocation mechanism may force opposite rotation of the pair of leg members with respect to each other. Various resistance mechanisms may be adapted to the apparatus to offer resistance to the striding-type motion.

13 Claims, 8 Drawing Sheets

STRIDING EXERCISER

BACKGROUND OF THE INVENTION

1. Field:

This invention relates to exercise apparatus and particularly to an apparatus for performing striding-type exercises.

2. State of the Art:

Various exercises such as walking, running and cross-country skiing involve a striding-type motion of the user's legs for, among other things, increasing strength in the legs and aerobic conditioning. There are various devices such as treadmill exercisers and cross-country skiing exercisers which are adapted to allow an exerciser to simulate such exercises in a restricted space.

SUMMARY OF THE INVENTION

An exercise apparatus has a frame which has a first side spaced apart from a second side for supporting an upright user between the first and second sides above a support surface. A first pedal means and a second pedal means are each rotatably mounted to the first side and the second side respectively of the frame. The first and second pedal means each have a foot support means to support one foot of the user and a pedal axis of rotation which is proximate the hips of the user when the user is positioned generally upright on the foot support means. The first and second pedal means each rotate about its respective pedal axis of rotation through an arc by movement of the user's feet to simulate a striding-type movement.

Preferably, the exercise apparatus of the invention includes a first handle means and a second handle means adapted to the first and second sides of the frame for grasping by the hands of the user when the user is positioned generally upright upon the foot support means. Preferably, the first and second handle means are each rotatably adapted to the first and second sides to rotate about a handle axis of rotation upon movement of the first and second handle means by the user. It is highly preferred that the pedal axis of rotation and the handle axis of rotation are the same and that the first and second handle means are each mechanically linked respectively to the first and second pedal means to pivotally move simultaneously with respect to the frame. The exercise apparatus also preferably includes a resistance means mechanically interconnected between each of the first and second pedal means and the frame for resisting pivotal movement of the first and second pedal means relative to the frame.

An exercise apparatus of the invention may also include a reciprocating mechanism comprising a cable means in connective association, preferably forming an endless loop, between the first and second pedal means. The cable means forces the first and second pedal means to reciprocate with respect to each other in their swinging motion. The reciprocating mechanism may also include a guide means for training the cable means away from the first and second pedal means. Embodiments having a reciprocating mechanism may also have resistance means associated with the frame and the cable means to resist the reciprocating motion of the pedal means.

In another embodiment, a first journal means and a second journal means are desirably adapted to the first and second sides respectively, of the frame. The first and second journal means each have an axis of rotation positioned proximate the hips of the upright user. A first connection member and a second connection member are adapted to the first and second journal means respectively to rotate about the first and second journal means. A first foot support and a second foot support are adapted to the first and second connection members, respectively, to support the feet of the user. The first and second foot supports are spaced from the axis of rotation of the first and second journal means for movement by the user's feet through an arc in a striding-type movement. The first and second handle means are adapted to the first and second connection members respectively at the first and second journal means respectively to simultaneously rotate with the connection members. A resistance means is included for resisting pivotal movement of the first and second connection members.

In preferred embodiments, the frame may be comprised of a first "U"-shaped member having a base member for positioning on the support surface and a second "U"-shaped member also having a base member for positioning on the support surface. The first and second "U"-shaped members each have extension members mounted substantially normal to the opposite ends of their respective bases, with each of the extension members rotatably adapted to the first and second journal means to move relative to the first and second journal means between a first storage position and a second exercise position. Preferably, the first "U"-shaped member is sized with respect to the second "U"-shaped member to be closely proximate to it when the frame is in its storage position.

In a preferred embodiment, the resistance means is comprised of a pair of first friction members associated with each of the first and second connection members, each of which is adapted to rotate with its respective connection member. A second pair of friction members is connected to the frame and each is configured and adapted to frictionally register with a respective first friction member to offer resistance to the rotation of each of said first friction members relative to the frame. An adjustment means is provided to vary the frictional resistance between the first and second friction members. Adjustment means here desirably is comprised of a bolt member which associates with and rotatably attaches the first and second friction members to each other. The bolt member has threads at a distal end. A nut member rotatably registers with the threads of the bolt member. The nut member is configured and adapted to vary the normal force between the first and second friction members upon rotation of the nut member. Rotation of the nut member thus provides varying resistance to rotation of the first and second connection members with respect to the frame. Alternatively, the resistance means may be a fluid resistance device associated with the frame and the first and second connection members.

In a highly preferred embodiment of the invention, the axis of rotation of the first and second journal means are coaxial and the first and second foot support means are rotatably mounted to the first and second connection members respectively.

DETAILED DESCRIPTION OF THE DRAWINGS

Figure 1:
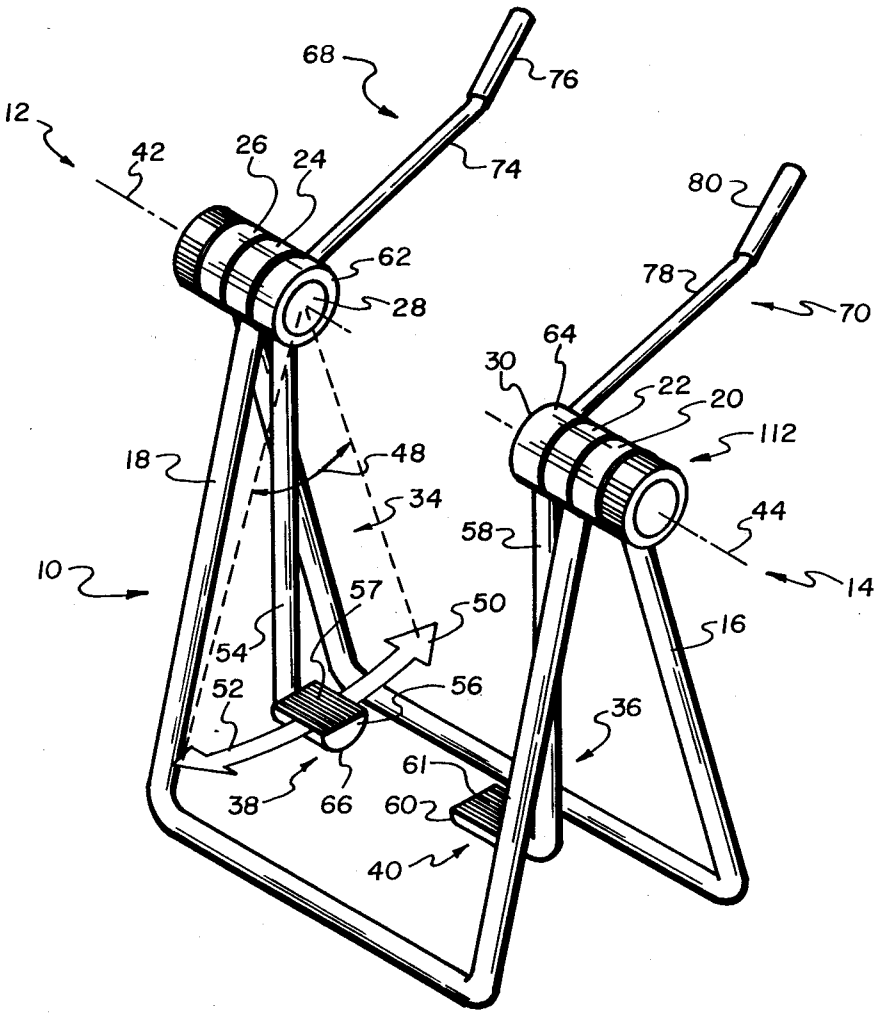
FIG. 1 is a perspective view of an exercise apparatus of the invention.

Referring to FIG. 1, an exercise apparatus of the invention includes a frame, generally indicated at 10, having a first side, generally indicated at 12, and a second side, generally indicated at 14. The frame 10 serves to support a user mounted on the apparatus above any solid support surface, such as a floor. The frame 10 supports an upright user between the first side 12 and the second side 14.

In the embodiment of FIG. 1, the frame 10 is comprised of a first U-shaped frame member 16, and a second U-shaped frame member 18. Frame members 16 and 18 are rotatably associated with each other at frame hubs 20, 22, 24, and 26, which are generally cylindrical pivoting members. Frame hubs 20 and 26 are firmly attached to frame member 16, as shown, and frame members 22 and 24 are firmly connected to frame member 18, as shown. A pivot shaft 28 passes through a cylindrical bore formed in frame hubs 24 and 26, and a pivot shaft 30 passes through a cylindrical bore formed in each of frame hubs 20 and 22. Frame hubs 20, 22, 24, and 26 rotatably associate with pivot shafts 28 and 30 to allow frame members 16 and 18 to pivotally associate with each other. Frame members 16 and 18 pivot with respect to each other, but have a locking mechanism for precluding members 16 and 18 from opening beyond their exercise position shown in FIG. 1. A typical such locking mechanism will be discussed hereinafter in reference to FIG. 4.

Other embodiments of a frame are within contemplation. Any frame structure which is stable and sturdy, which serves to support a user in an upright position between a first and second side is acceptable. Another embodiment of a frame is disclosed in reference to FIG. 10.

The exercise apparatus of FIG. 1 also includes a first pedal means, generally indicated at 34, and a second pedal means generally indicated at 36. The first pedal means 34 is rotatably mounted to the first side 12 of the apparatus, and the second pedal means 36 is rotatably mounted to the second side 14 of the apparatus. The first pedal means 34 has a first foot support means, generally indicated at 38, and the second pedal means 36 has a second foot support means, generally indicated at 40. The first pedal means 34 has a pedal axis of rotation 42, and the second pedal means 36 has a pedal axis of rotation 44 which is preferably coaxial with the axis 42. The pedal axes of rotation, 42 and 44, are positioned to be proximate the hips of the user when the user is positioned generally upright with one foot on each of the foot support means, 38 and 40.

The first and second pedal means, 34 and 36, are each rotatable about its respective axis of rotation, 42 or 44, through an arc of movement, indicated by angle 48, by the user's feet to simulate a striding-type movement. The foot support means may be moved in the forward direction, indicated by arrow 50, or in the rearward direction, indicated by arrow 52. Angle 48 depends on the desired characteristics of the apparatus and the amount of "stride" which the user is intended to engage in while exercising. Angle 48, however, is less than about 180°.

In the embodiment of FIG. 1, the first pedal means includes a leg member 54 and a foot support 56 having a ridged non-slip upper surface 57. The second pedal means 36 includes a second leg member 58 and a second foot support 60 having a ridged non-slip upper surface 61. Leg member 54 is firmly connected to rotating hub 62, and leg member 58 is firmly connected to rotating hub 64. Rotating hub 62 is rotatably connected to frame 10 by means of pivot shaft 28, and rotating hub 64 rotatably associates with frame 10 by means of pivot shaft 30.

Pivot shaft 28 constitutes a first journal means and pivot shaft 30 constitutes a second journal means which are adapted to the first side 12 and second side 14, respectively of the frame 10. The first journal means has axis of rotation 42 and the second journal means has axis of rotation 44 which are adapted to be proximate the hips of an upright user, and in FIG. 1 are collinear. In FIG. 1, leg member 54 constitutes a first connection member and leg member 58 constitutes a second connection member which are adapted to the first and second journal means respectively to rotate thereabout. As shown, the first foot support 56 and the second foot support 60 are connected to the first and second connection members respectively.

Other embodiments of a first and second pedal means and a first and second journal means are within contemplation. For example, in certain embodiments, it may be preferable for the pivoting association between the pedal means and the frame to be of a universal pivot nature. Such a universal pivoting relationship may be accomplished, for example, by a ball and socket joint connecting the pedal means to the frame. Alternatively, foot support means, such as foot supports 56 and 60 may be stirrups connected to a frame by a cable or strap.

Foot support 56 is rotatably associated with leg member 54 by means of a pivot shaft 66 which passes through and rotatably associates with foot support 56 and firmly connects to leg member 54. Foot support 60 rotatably attaches to leg member 58 by a pivot shaft not visible in FIG. 1.

Other embodiments of foot supports or foot support means are also within contemplation. For example, foot supports 56 and 60 may be replaced by common bicycle pedals which typically rotatably associate with a shaft by means of ball bearings. Alternately, it may be preferable to rigidly connect foot supports to their respective connection members so that the foot supports do not pivot with respect to the connection members.

The exercise apparatus also includes a first handle means, generally indicated at 68, and a second handle means generally indicated at 70. The first handle means 68 is adapted to the first side 12 of the frame 10, and he second handle means 70 is adapted to the second side 14 of the frame 10 to be grasped by the hands of the user when the user is positioned generally upright with one foot on each of the foot support means, 38 and 40. The first handle means 68 and the second handle means 70 each pivot about a handle axis of rotation, which in the embodiment of FIG. 1, is the same as the respective pedal axes of rotation, 42 and 44. Also, in the embodiment of FIG. 1, the first and second handle means, 68 and 70, are mechanically linked respectively to the first and second pedal means, 34 and 36 to pivotally move simultaneously with the first and second pedal means, 34 and 36, respectively.

In the embodiment of FIG. 1, the first handle means includes an arm member 74, and a hand grip 76. The second handle means 70 includes an arm member 78 and a hand grip 80. Arm members 74 and 78 are preferably cylindrical tubular members firmly connected in a conventional manner to rotating hubs 62 and 64, respectively. Hand grips 76 and 80 are connected to arm members 74 and 78 to provide a comfortable and non-slipping surface for the user's hands. Hand grips 76 and 80 are preferably formed of hard foam, but may also be made of plastic or other suitable substances.

Figure 3:
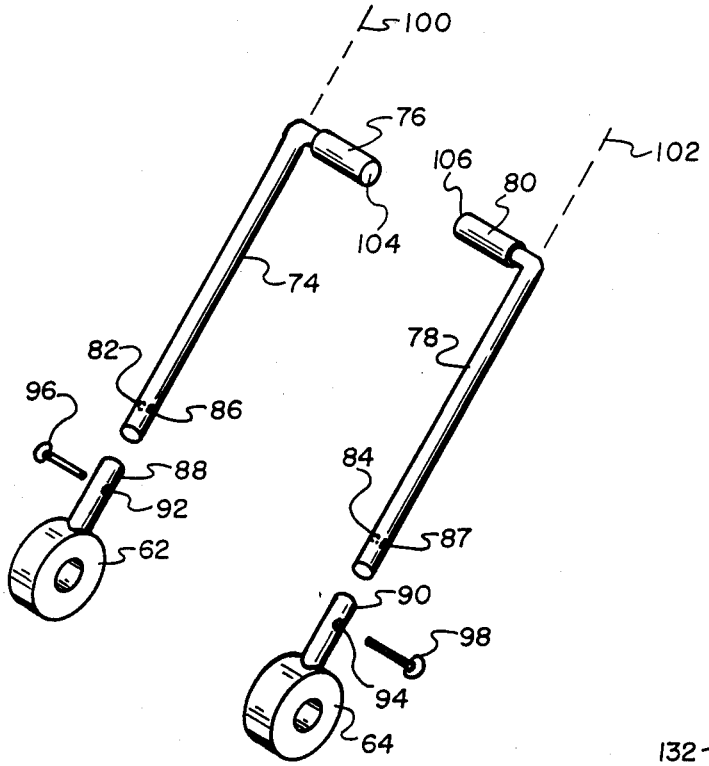
FIG. 3 is a perspective schematic view of an alternative embodiment of a handle means of the invention.

Alternative embodiments of handle means are within contemplation. For example, arm members such as members 74 and 78 may be adapted to be reoriented in length or shape to provide differing orientations of the user's hands or arms while performing exercises. For example, as shown in FIG. 3, arm members 74 and 78 may be provided with holes 82 and 84, and holes 86 and 87. Also, arm members 88 and 90, which in FIG. 1 form part of arm members 74 and 78, are firmly connected to rotating hubs 62 and 64. Arm members 88 and 90 are tubular members having an inside diameter which snugly receives members 74 and 78, respectively. Also, arm members 88 and 90 have holes 92 and 94 which are adapted to register with holes 82 and 84, or holes 86 and 87 respectively.

To do exercises in the palms-down position, arm members 74 and 78 are slid into arm members 88 and 90 generally in the orientation shown in FIG. 3. Pins 96 and 98 are then slid into the channel formed by the registration of holes 92 and 86 and by the holes 94 and 87 to lock arm members 74 and 78 in the orientation described. Pins 96 and 98 are of a type which are common in the art. Arm member 74 may be rotated counter-clockwise 90 degrees to bring hole 82 in registration with hole 92. Arm member 78 may be rotated clockwise 90 degrees as viewed in FIG. 3 to bring hole 84 in registration with hole 94. Pins 96 and 98 are then placed in the channels formed by the registration of these holes to lock arm members 74 and 78 in their new orientation. In this orientation, the user may perform exercises with his hands in a palms-in orientation.

Referring back to FIG. 1, the exercise apparatus also includes a first resistance means generally indicated at 110 and a second resistance means generally indicated at 112. The first and second resistance means, 110 and 112, are mechanically interconnected between each of the first and second pedal means, 34 and 36, and the frame 10 for resisting the pivotal movement of the first and second pedal means, 34 and 36, relative to the frame 10. A more detailed description of various embodiments of resistance means is discussed hereinafter.

Figure 4:
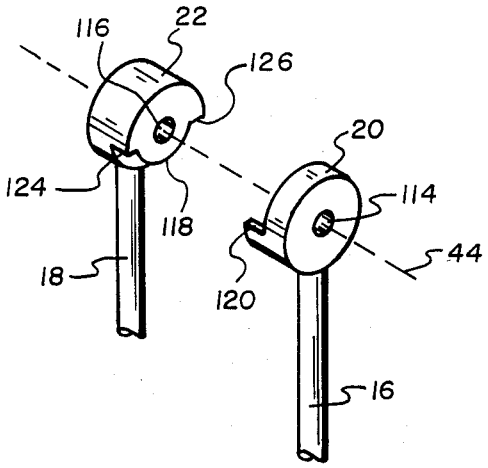
FIG. 4 is a perspective view of a dog and notch assembly of the invention.

As stated, frame members 16 and 18 pivot with respect to each other, but have a locking mechanism to preclude them from opening with respect to each other beyond their exercise position as shown in FIG. 1. One such locking mechanism is illustrated in FIG. 4. In FIG. 4, frame hub 20 and frame hub 22 are shown disassembled. Frame hubs 20 and 22 have cylindrical bores 114 and 116 to permit passage of pivot shaft 30, about which frame hubs 20 and 22 rotate when assembled. A semi-circular notch 118 is formed in frame hub 22. A semi-circular extension or "dog" 120, which is smaller in size than semi-circular notch 118 is formed on frame hub 20. When frame hubs 20 and 22 are assembled, dog 120 registers within semi-circular notch 118. As viewed in FIG. 4, if frame hub 20 is rotated clockwise with respect to frame hub 22, dog 120 registers with surface 124 of notch 118, and precludes hub 20 from further so rotating. If rotating hub 20 rotates counter-clockwise with respect to hub 22, dog 120 engages with surface 126 of notch 118 and also precludes hub 20 from further so rotating. The registration between dog 120 and notch 118 therefore provides a mechanism for precluding the frame members 16 and 18 from opening beyond their desired positions. A similar structure is also associated with frame hubs 24 and 26.

Figure 5:
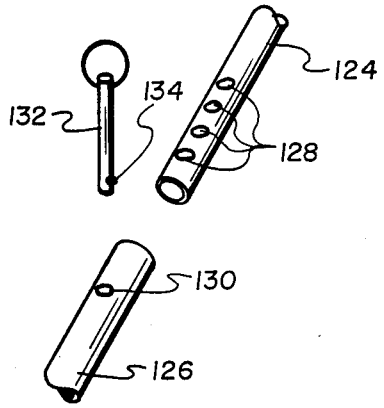
FIG. 5 is a perspective schematic view of a length adjustment means for adjusting the length of a pedal means or handle means of the invention.

The pedal means and/or the handle means may be adapted to be adjustable in length by any of various methods. For example, leg members 54 and 58 or arm members 74 and 78 may be adjustable in length by the method disclosed in FIG. 5. In FIG. 5 a leg member or arm member is divided into two separate sections, i.e., sections 124 and 126. Both sections 124 and 126 are tubular, section 126 having an inside diameter sized to snugly receive the outside diameter of Section 124. A plurality of holes 128 are formed in section 124 so as to provide a plurality of channels passing through the diameter of section 124. A single hole 130 is similarly formed to pass through the diameter of section 126. Section 124 is slid into section 130 to bring one of the plurality of holes 128 into alignment with hole 130. Pin 132, having a spring loaded button 134 is then slid through the channel formed by the registration between hole 130 and one of holes 128 to firmly lock section 124 in its selected position with respect to section 126. The length of the leg or arm member is adjusted by selecting an appropriate hole 128 of section 124 to be placed in registration with hole 130 as described.

Figure 2:
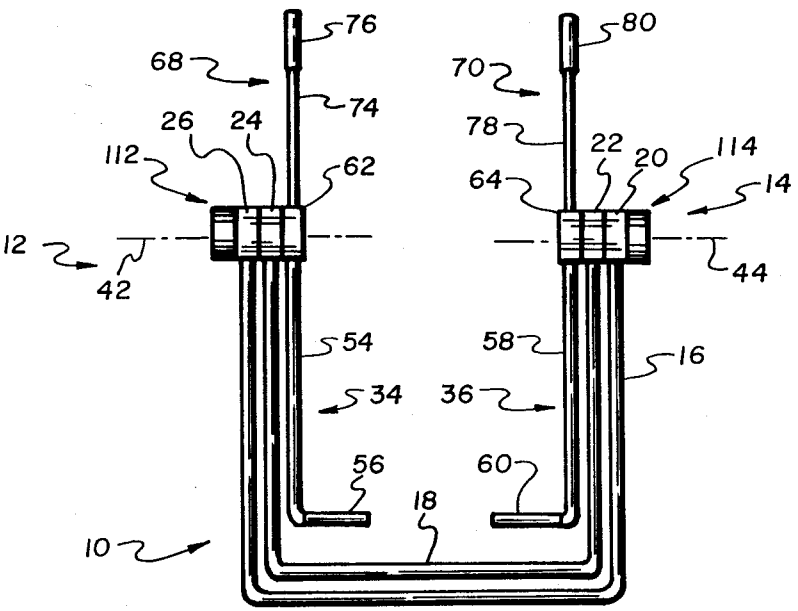
FIG. 2 is a front plan view of the apparatus of FIG. 1.

The apparatus is shown in FIG. 1 in exercise position. However, the frame 10 is adapted to that it may be conveniently folded to occupy less space. As shown in FIG. 2, frame member 16 may be rotated with respect to frame member 18 in such a way that leg members 54 and 58, and frame members 16 and 18 are all in general alignment, thus collapsing the frame to a more compact storage position. Arm members 74 and 78 may be adapted to be removable from hubs 62 and 64 in order to make the apparatus even more compact.

Figure 6:
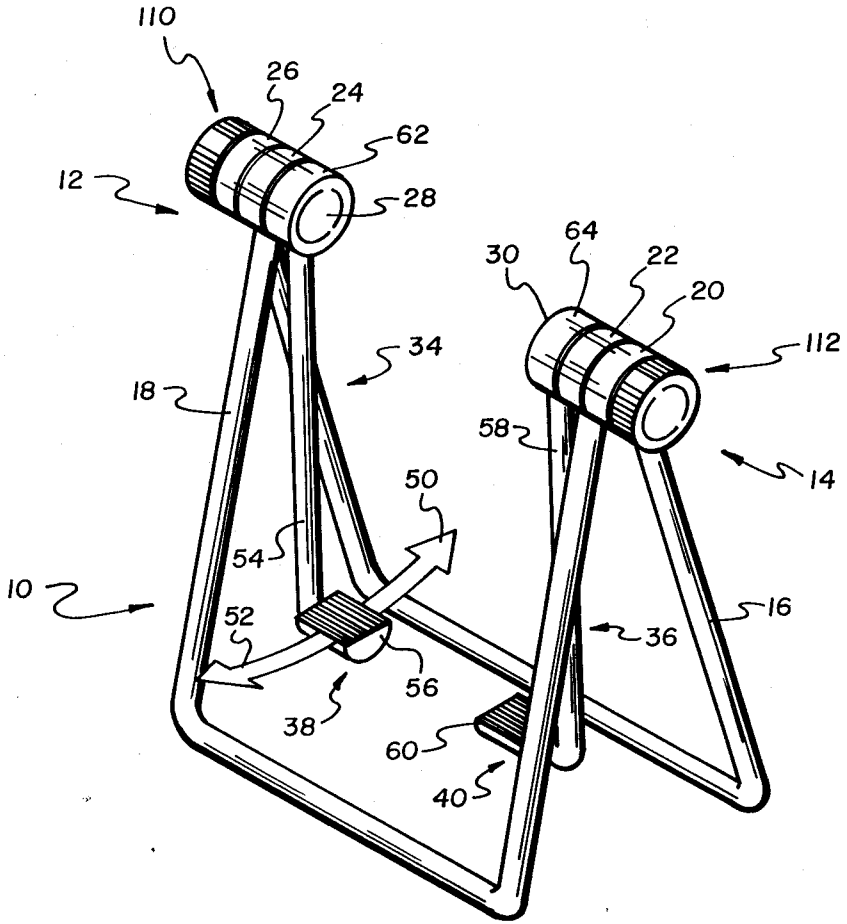
FIG. 6 is a perspective view of an alternative embodiment of an exercise apparatus of the invention.
Figure 7:
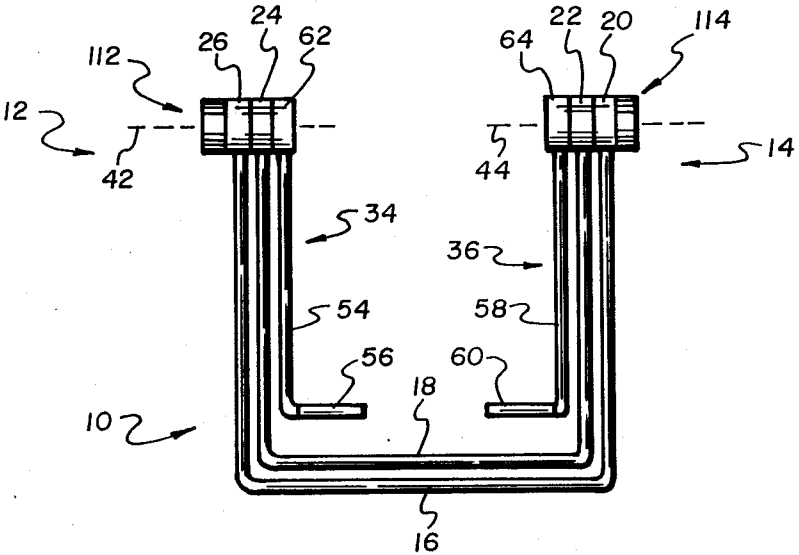
FIG. 7 is a front plan view of the apparatus of FIG. 6.

FIGS. 6 and 7 illustrate an embodiment of the exercise apparatus of the invention which is similar to the embodiment disclosed in FIGS. 1 and 2, except that the embodiment of FIGS. 6 and 7 do not have handle means such as first and second handle means 68 and 70. The lack of handle means alters the characteristics of exercises performed on the embodiment of FIGS. 6 and 7. Also, foot supports 56 and 60 do not rotatably associate with leg members 54 and 58. It is currently believed that foot supports 56 and 60 being non-rotatable in the embodiment of FIGS. 6 and 7 provides better stability to an exerciser when performing exercises without the aid of handle means. In the embodiment of FIGS. 6 and 7, the user may wish to grasp frame hubs 20, 22, 24, and 26 to steady himself while performing exercises while supporting his feet upon foot supports 56 and 60.

Figure 8:
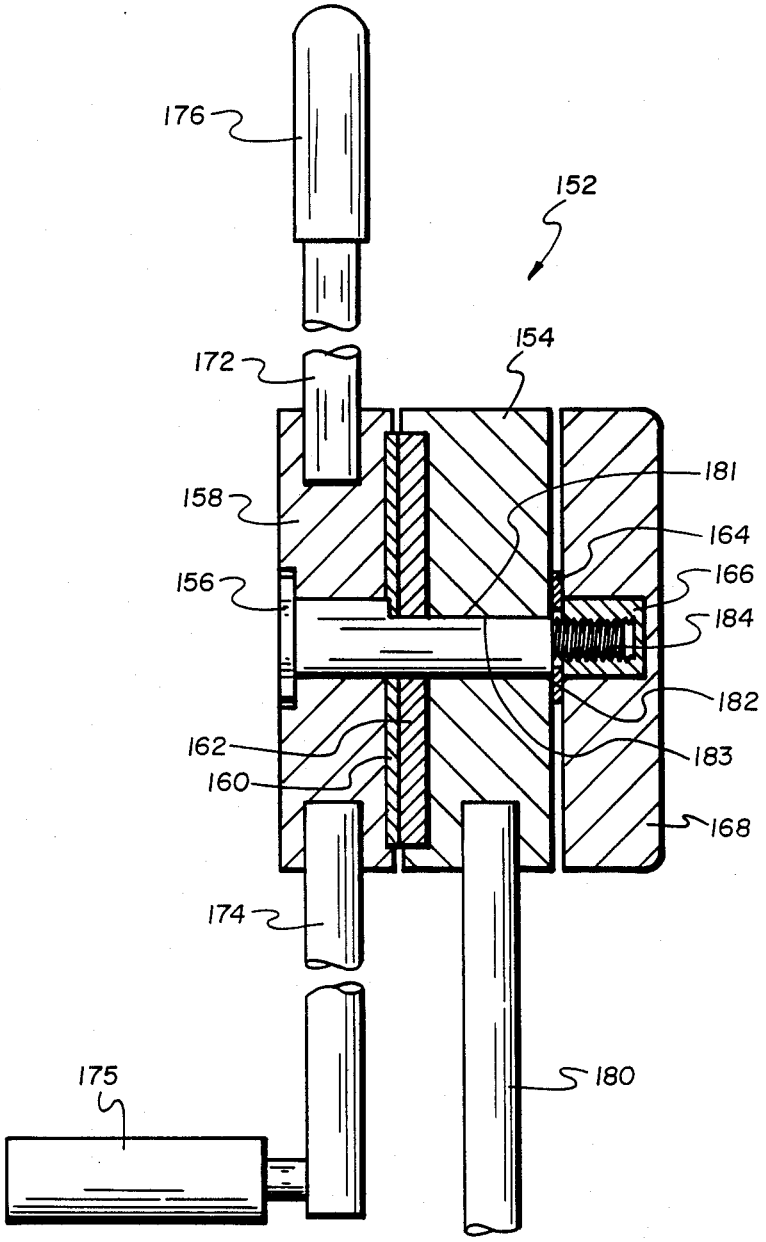
FIG. 8 is a side sectional view of a resistance means of the invention.

FIG. 8 illustrates a resistance means of the invention generally indicated at 152, which in this embodiment includes a frame hub 154, a pivot shaft 156, a rotating hub 158, a friction member 160, a friction member 162, a thrust bearing 164, a nut 166, and a tension adjust knob 168.

In the embodiment of FIG. 8, rotating hub 158 connects to arm member 172 and to leg member 174, as shown. Arm member 172 corresponds to arm members 74 or 78 of FIG. 1, and leg member 174 corresponds to leg member 54 or 58 of FIG. 1. Foot support 175 corresponds to foot supports 56 or 60 of FIG. 1. The support 175 is a pedal which rotates about the illustrated shaft. Hand grip 176 corresponds to hand grip 76 or 80 of FIG. 1. Frame hub 154 connects to frame member 180, which corresponds member 18 in FIG. 1. In the embodiment of FIG. 8, the frame member which corresponds to frame member 16 of FIG. 1 is not shown but is rigidly mounted upon frame hub 154 in alignment with frame member 180, as viewed in FIG. 8, but diverging from frame member 180 at approximately the same angle a between the frame members 16 and 18 in FIG. 1.

Friction member 160 constitutes a first friction member and friction member 162 constitutes a second friction member. Pivot shaft 156 constitutes a bolt member; tension knob 168 and nut 166 constitute a nut member. The bolt member and the nut member together constitute an adjustment means for adjusting the frictional resistance to movement of the pedal means relative to the frame. The adjustment means of the embodiment of FIG. 8 accomplishes adjustment of frictional forces by increasing or decreasing the normal force exerted between the first and second friction members. Other embodiments of adjustment means are within contemplation. For example, the nut member may be of a wing nut type. The bolt member and nut member may also be reversed in their position. In other words, the bolt member may be threaded from the frame side of the apparatus towards the pedal means, the nut member registering with the bolt member and being rotatably associated with the pedal means. The friction members should be composed of a suitable substance to mutually and frictionally register to provide frictional forces opposing rotational movement of the pedal means with respect to frame. Friction members may be formed of any of various materials to provide the desirable friction characteristics without undue wear. In the embodiment of FIG. 8, friction disk 160 is preferably a steel plate.

Pivot shaft 156 is mounted in a fixed rotational relationship with respect to frame hub 154. As shown, pivot shaft 156, which is a generally cylindrical saddle bolt, is notched at notch 181 and registers with a generally cylindrical channel 182 formed in frame hub 154, which has a flattened surface 183 to register with notch 181. Rotating hub 158 and pivot shaft 156 are formed of an appropriate friction resistive metal or other substance to allow pivoting motion between rotating hub 158 and pivot shaft 156 without significant resistance or wear. Friction member 160 is firmly affixed to rotating hub 158 and friction member 162 is firmly attached to frame hub 154.

Nut 166, which is preferably brass, is firmly connected to tension knob 168. Nut 166 threadingly associates with the threads 184 of pivot shaft 156. Rotatably associated between tension adjust knob 168 and frame hub 154 is a thrust bearing 164. When tension knob 168 is rotated clockwise, nut 166 draws pivot shaft 156 and hence rotating hub 158, toward frame hub 154 to increase the normal force between friction member 160 and friction member 162, thus increasing frictional resistance to the rotational motion of rotating hub 158 with respect to frame hub 154. Thrust bearing 164 provides a rolling reduced friction mechanism whereby tension adjust knob 168 may be more easily rotated with respect to frame hub 154.

Figure 9:
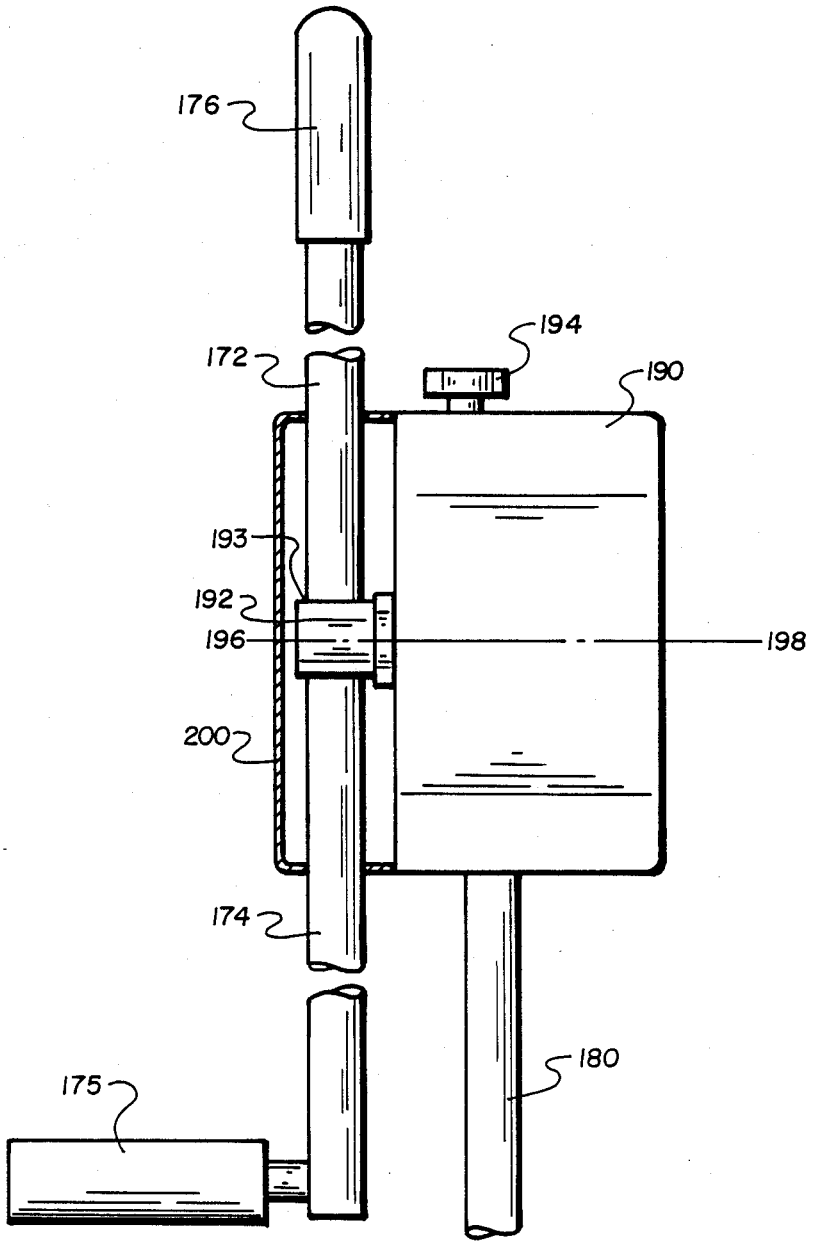
FIG. 9 is a side sectional view of an alternative embodiment of a resistance means of the invention.

FIG. 9 illustrates another embodiment of a resistance means of the invention. The resistance means of FIG. 9 includes a rotary hydraulic unit 190, a hydraulic shaft member 192, and a tension adjustment knob 194. Hydraulic shaft member 192 includes a cylindrical collar 193 adapted to receive and firmly connect to arm member 172 and leg member 174, which in the embodiment of FIG. 4 are comprised of a single tubular member. Rotary hydraulic unit 190 is of a type which is commonly known and which provides resistance to rotational movement of shaft member 192 along axis 196, 198. Tension adjustment knob 194 rotates to adjust the amount of resistance rotary hydraulic unit 190 provides to the rotational motion of hydraulic shaft member 192. Rotary hydraulic unit 190 is also fitted with a cap 200 which allows rotational movement of arm member 172 and leg member 174 about rotational axis 196, 198 and yet provides protection between a user's legs and hydraulic shaft member 192. Cap 200 may also improve the aesthetic appearance of the resistance mechanism illustrated in FIG. 9. As with the embodiment of FIG. 8, the resistance means of FIG. 9, in this case rotary hydraulic unit 190, is connected directly and rigidly to frame member 180 and its corresponding frame member (not shown).

Other embodiments of resistance means are within contemplation. For example, it may be advantageous to associate the pedal means with an inertia device, such as a heavy rotating flywheel. An inertia device may be advantageous because such devices provide increasing resistance with increased motion, thus more closely resembling actual resistance felt by an exerciser, for example, when running or ski touring. Or it may be advantageous to associate a spring, such as a heavy clock-type spring, with the pedal means and the frame. Such a spring offers increased resistance with increased angular displacement of the pedal means with respect to the frame as a function of the spring constant of the spring. It may also be advantageous to directly connect the resistance means between the frame and a leg member, such as leg member 20 or other portions of the pedal means for example, to offer increased mechanical advantage to the resistance means.

Also, it is not necessary that equal force be exerted in the forward swing motion as in the rearward swing motion in embodiments having resistance mechanisms. To simulate a walking or a cross-country skiing exercise, for example, it may be advantageous to have the resistance exerted only when the foot support is moved in the rearward direction. The pedal means may be linked to the resistance mechanism through a one-way clutch, which engages the resistance mechanism when the foot support means moves rearward, but "free wheels" when the foot support means moves forward. One embodiment of such a one-direction clutch is discussed hereinafter in reference to FIGS. 15 and 16.

Figure 10:
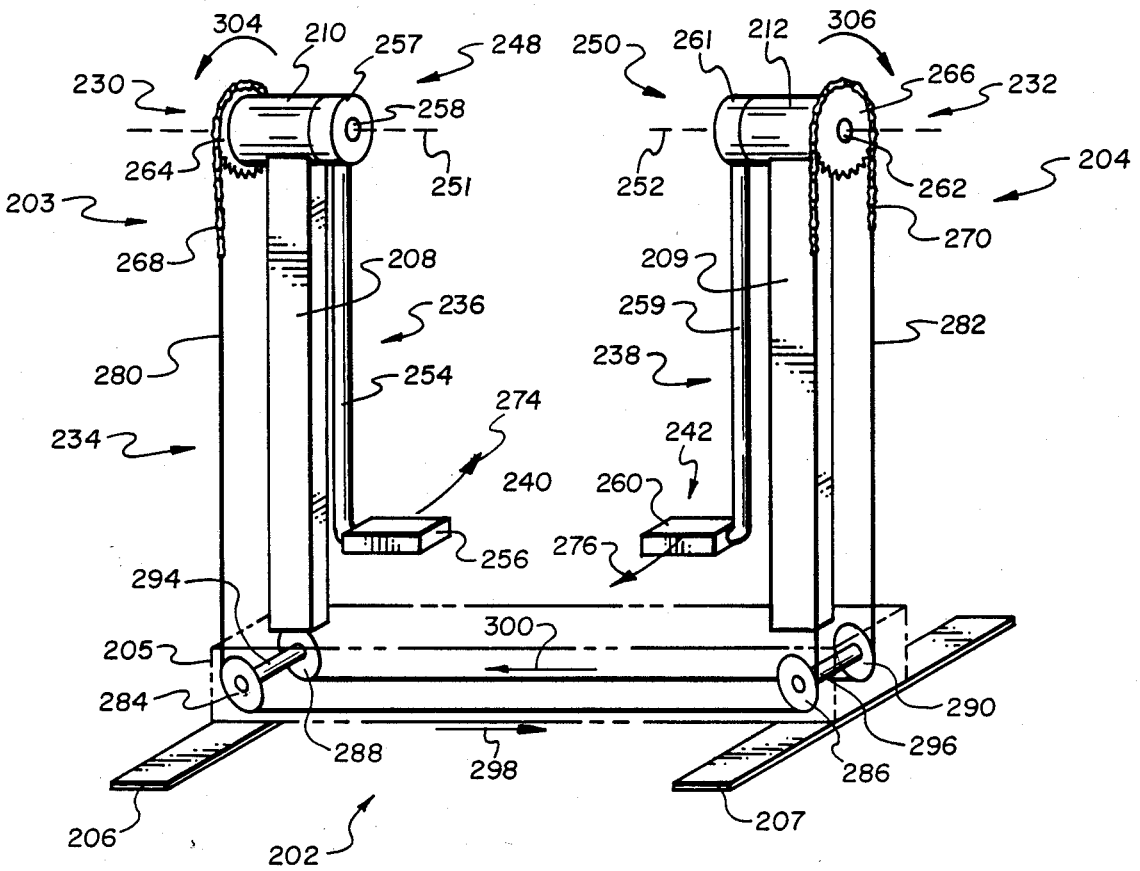
FIG. 10 is a schematic view of an exercise apparatus including a reciprocating mechanism of the invention.

FIG. 10 is a perspective schematic illustration of an exercise apparatus of the invention having a reciprocating mechanism of the invention. The frame, generally indicated at 202 will first be described. The frame 202 includes a first side generally indicated at 203 and a second side generally indicated at 204. The frame 202 includes a rectangular box-shaped longitudinal base member 205 (shown in phantom lines), transverse base members 206 and 207, and upright frame members 208 and 209. Longitudinal base member 205 constitutes a main beam of the frame for supporting other structures of the frame and for housing portions of the reciprocating mechanism as hereafter discussed. Firmly connected to and under longitudinal member 205 are transverse members 206 and 207 which give lateral stability to the frame, especially when an exerciser is mounted on the apparatus and performing exercises. Upright members 208 and 209 are firmly connected to longitudinal member 205. Frame hubs 210 and 212 are firmly connected to upright members 208 and 209 as shown.

A reciprocating mechanism of the invention includes a first engagement means, generally indicated at 230, a second engagement means, generally indicated at 232, and a cable means, generally indicated at 234. Other portions of the exercise apparatus include a first pedal means generally indicated at 236, a second pedal means generally indicated at 238, a first foot support means generally indicated at 240, and a second foot support means generally indicated at 242. A first journal means is generally indicated at 248 and a second journal means is generally indicated at 250. The apparatus has a first pedal axis of rotation 251 and a second pedal axis of rotation 252.

First pedal means 236, including connection member 254 and foot support 256 is firmly connected to rotating hub 257 which rotatably associates with frame hub 210 by means of a pivot shaft 258. Similarly, second pedal means 238, including second connection member 259 and second foot support 260 is firmly connected to rotating hub 261 which rotatably associates with frame hub 212 by means of pivot shaft 262, as shown. First engagement means 230 is firmly connected to pivot shaft 258, and second engagement means 232 is firmly connected to pivot shaft 262. In the embodiment of FIG. 10, the first and second engagement means, 230 and 232, are shown to be chain sprockets 264 and 266 respectively, which register or engage in a non-slip relationship with chain members 268 and 270, as shown in a manner which is well known. However, the first and second engagement means, 230 and 232, may be comprised of other engagement mechanisms. For example, the first and second engagement means may be pulleys which engage in a non-slip relationship with associating belt members. If pulleys and belts are used, the pulleys may include a portion which is crimped onto the pulley, for example at the top of the pulley to secure a non-slip association between belt and pulley.

The cable means 234 engages in an endless loop association with the first and second pedal means 236 and 238 at the first and second engagement means 230 and 232 to cause the pedal means 236 and 238 to reciprocate in their swinging motion with respect to the frame 202. In other words, when first pedal means 236 moves forward in the direction of arrow 274, the second pedal means 238 is forced to rotate in the direction of arrow 276, and when the first pedal means 236 moves in the direction of arrow 276, the second pedal means 238 is forced to rotate in the direction of arrow 274. Thus, when a user is mounted on the apparatus, his legs must reciprocate with respect to each other, much in the same way that a person's legs reciprocate in a striding-type motion. The reciprocating mechanism precludes the user's legs from both moving in the same direction at the same time, which may advantageously preclude the user from losing his balance or falling from the apparatus.

In the embodiment of FIG. 10, the cable means 234 includes a first cable member 280, a second cable member 282, first chain member 268 and second chain member 270. The first cable member 280 and the second cable member 282 are firmly connected to the chain members 268 and 270, as shown. The first cable member is trained around pulley members 284 and 286, as shown, and the second cable member is trained around pulley members 288 and 290 as shown. Pulley members 284 and 286 constitute a first guide means and pulley members 288 and 290 constitute a second guide means. The first and second guide means act to train the first and second cable members, 280 and 282, respectively, into an endless loop association between the first and second pedal means 236 and 238 to force their reciprocating motion. The first and second guide means also act to remove the cable means 234 within frame member 205 and away from areas which may interfere with other portions of the apparatus or the user's body.

Pulley members 284 and 288 rotate about a pivot shaft 294 which is firmly connected to longitudinal frame member 205. Pulley members 286 and 290 rotate about pivot shaft 296 which is also firmly connected to frame member 205. Pulley members 284 and 286 allow first cable member 280 to move in the direction of arrows 29 or 300, and pulley members 288 and 290 allow cable member 282 to move in the direction of arrows 298 or 300. Pulley members 284, 286, 288, and 290 may be simple pulleys. Or, if formed of a friction resistant material may be fixed guides upon which the cable members ride.

When first foot support 256 moves in the direction of arrow 274, sprocket 264 rotates in the direction of arrow 304. The rotation of sprocket 264 in the direction of arrow 304 causes first cable member 280 to move in the direction of arrow 298 and second cable member 282 to move in the direction of arrow 300. As the cable members 280 and 282 move in the directions indicated, sprocket 266 is forced to rotate in the direction of arrow 306. Should foot support 256 move in the direction of arrow 276, the reverse of the motion described above is effectuated. Thus, the reciprocating mechanism disclosed in FIG. 10 causes the pedal means 236 and 238 to reciprocate with respect to each other.

Figure 11:
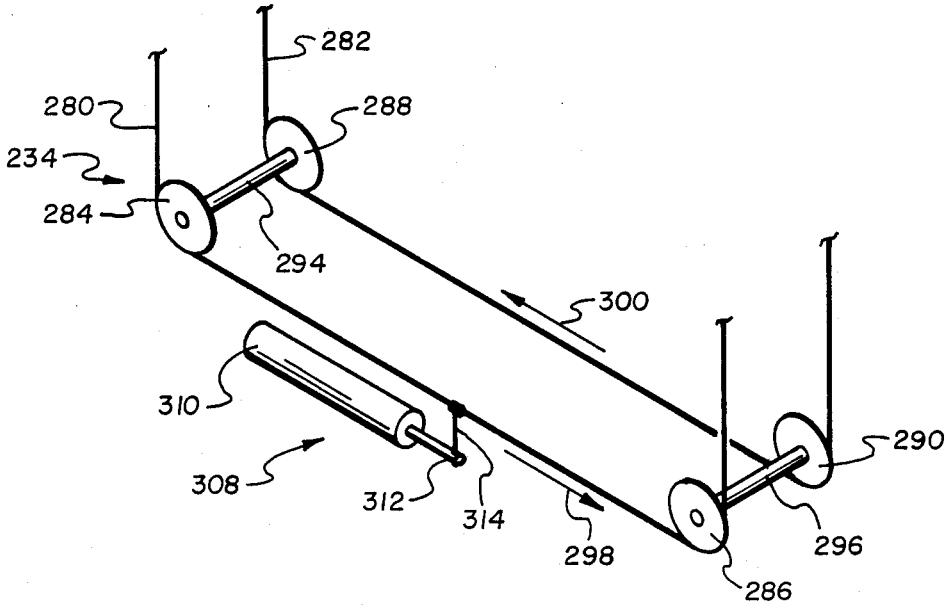
FIG. 11 is a schematic view of a resistance means of the invention to be used in conjunction with the reciprocating mechanism of FIG. 10.

FIG. 11 is a schematic illustration of a resistance means, generally indicated at 308, which acts to exert resistance upon the motion of cable member 280 either in the direction of arrow 298 or in the direction of arrow 300. The resistance means 308 thus acts to exert resistance upon the reciprocating motion of the pedal means (not shown) in the manner described in reference to FIG. 10.

In the embodiment of FIG. 11 the resistance means 308 is comprised of a fluid cylinder 310, which has a piston rod 312 which firmly connects to cable member 280 by means of connection member 314. In the schematic illustration of FIG. 11, fluid cylinder 310 is firmly mounted to frame member 205 (not shown). Fluid cylinder 310 is of a type which is common for exerting resistance in the sliding motion of piston rod 312 either in the direction of arrow 298 or arrow 300. Thus, fluid cylinder 310 exerts resistance upon the motion of cable member 280 in the direction of arrow 298 or in the direction of arrow 300, thereby exerting resistance upon the reciprocating motion of the first and second pedal means (not shown).

Figure 12:
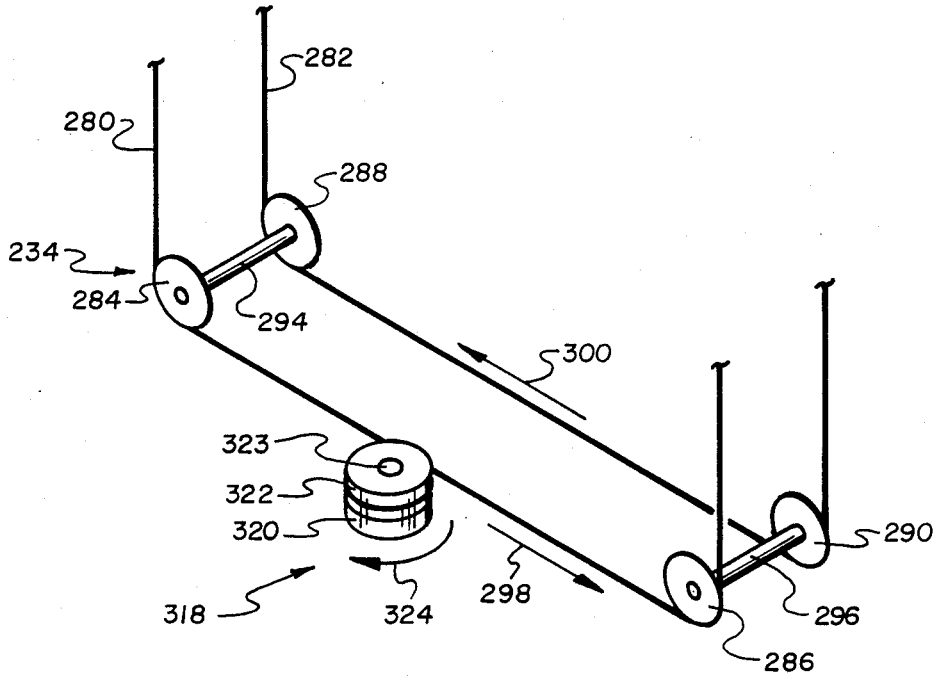
FIG. 12 is a schematic view of an alternative embodiment of a resistance means of the invention.

FIG. 12 is a schematic illustration of another embodiment of a resistance means of the invention. The resistance means of FIG. 12 generally indicated at 318, acts similarly to the resistance means 308 of FIG. 11, to exert resistance upon the motion of cable member 280, to in turn exert resistance upon the reciprocating motion of the pedal means (not shown).

Resistance means 318 includes a first friction member 320 and second friction member 322. In the schematic illustration of FIG. 12, friction member 320 is firmly connected in a non-rotating relationship to frame member 205 (not shown). Friction member 322 is rotatably associated with friction member 320 by means of pivot shaft 323. Cable member 280 is looped once around friction member 322 to cause cable 280 to register with friction member 322 in a non-slip association. When cable member 280 moves in the direction of arrow 298, friction member 322 rotates in the direction of arrow 324. When cable member 280 moves in the direction of arrow 300, friction member 322 rotates in the opposite direction. Friction member 322 frictionally registers with friction member 320 to offer resistance to the rotation of friction member 322 and hence to the reciprocating motion of the pedal means (not shown). Resistance means 318, including friction members 320 and 322 may be of a type the same or similar to the resistance means illustrated in FIG. 8, and may preferably include an adjustment mechanism similar to that disclosed in regard to FIG. 8 for adjusting the amount of frictional resistance offered between the friction members 320 and 322.

Figure 13:
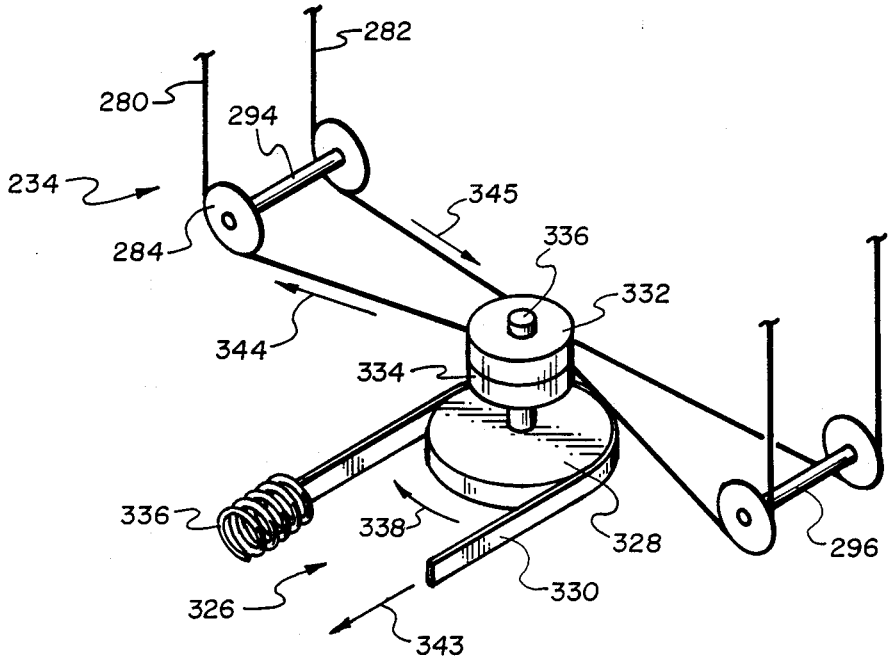
FIG. 13 is a schematic view of an alternative embodiment of a resistance means of the invention.

FIG. 13 illustrates another embodiment of a friction means of the invention which is generally indicated at 326. Similar to the embodiments of resistance means illustrated and disclosed with regard to FIGS. 11 and 12, the resistance means 326 of FIG. 13 also acts to exert resistance upon the motion of the cable means.

In the embodiment of FIG. 13, the resistance means 326 is comprised of a flywheel 328, a belt 330, a first clutch 332, a second clutch 334, and a spring 336. In the schematic illustration of FIG. 13, the flywheel 328 is rotatably attached to the frame member 305 (not shown). Clutch members 332 and 334 associate with pivot shaft 336, which is firmly attached to flywheel 328.

Figure 14:
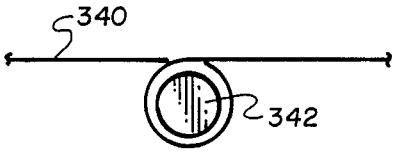
FIG. 14 is a schematic representation of the cable and clutch member of FIG. 13.

Cable member 280 is wound once around clutch member 334 in the orientation illustrated in the schematic representation of FIG. 14. Cable member 282 is wound once around clutch member 332 in the same orientation. In other words, in the schematic illustration of FIG. 14, member 340 represents either cable member 280 or 282 and member 342 represents either clutch member 334 or 332, respectively.

Clutch members 332 and 334 rotatably associate with axle 336 in such a way as to cause axle 336 to rotate only in the direction of arrow 338. In other words, should either of clutch members 332 or 334 rotate in the direction opposite to arrow 338, clutch member 332 or 334 would "free wheel" upon pivot shaft 336. Because of the association between cable members 280 and 282 and clutch members 334 and 332 respectively, it is not possible for both clutch members to rotate in the same direction at the same time. The internal mechanisms of clutch members 332 and 334 is discussed hereinafter in reference to FIG. 15. Belt 330 frictionally registers with flywheel 328 to offer resistance against the rotation flywheel 338. Adjustment to the amount of resistance exerted by belt 330 upon flywheel 328 may be made by adjusting the length of belt 330 by some length adjustment means in the direction of arrow 343. As either clutch member 332 or clutch member 334 rotates, axle 336 and hence, flywheel 328, in the direction of arrow 338, a constant resistance is exerted upon the reciprocating motion of the pedal means (not shown).

In other words, for example, when cable member 280 moves in the direction of arrow 344, cable member 282 must move in the direction of arrow 345. As cable member 282 moves in the direction of arrow 345, clutch member 332 will cause axle 336 and hence, flywheel 328 to rotate in the direction of arrow 338, thus offering resistance to the reciprocating action of the pedal means. When cable member 280 moves in the direction of arrow 345, clutch member 334 will cause axle 336 and hence, flywheel 328 to rotate in the direction of arrow 338. At the same time, however, cable member 282 will move in the direction of arrow 344, and will "free wheel" upon axle 336. Thus, the association between clutches 332 and 334, axle 336, and flywheel 328 offers continuous resistance to the reciprocating motion of the pedal means.

If flywheel 328 is heavy enough it may serve as an inertia device in conjunction with its frictional resistance characteristics as discussed. It may be advantageous for flywheel 328 to not be associated with a friction member such as belt 330. The flywheel 328 would thus serve more specifically as an inertia device for offering increased resistance with increased motion or reciprocating action of the pedal means.

Figure 15:
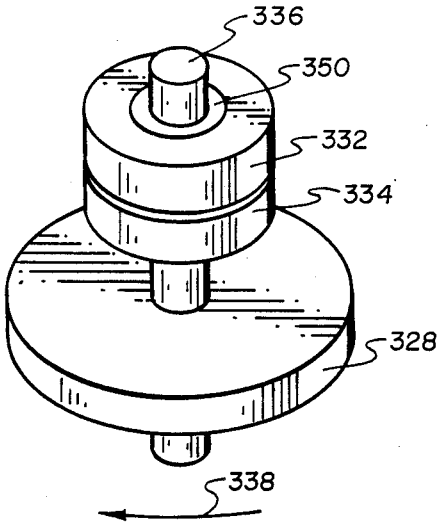
FIG. 15 is a schematic illustration of the clutch and flywheel mechanism of FIG. 14.

FIG. 15 is an enlarged perspective view of the clutch and flywheel mechanism of FIG. 13 and includes clutch member 332, clutch member 334, pivot shaft 336, flywheel 328, and one-way bearing 350. Pivot shaft 336 rotatably associates with frame member 305 (FIG. 10).

Figure 16:
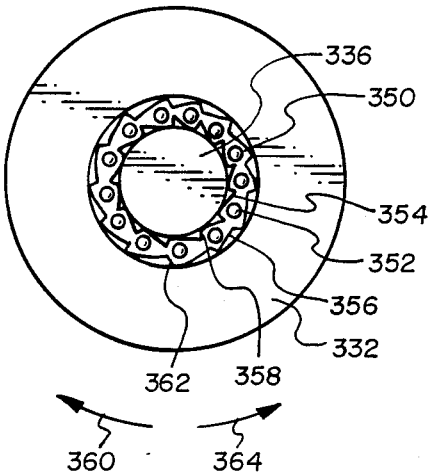
FIG. 16 is a schematic illustration of the one-way bearing of FIG. 15.

The internal mechanism of one way bearing 350 is schematically illustrated in FIG. 16. In the schematic illustration of FIG. 16, the pivot shaft 336 is shown centered within pulley member 332. However, pulley member 332 in FIG. 16 is identical to pulley member 334, for the two pulley members or clutch members 332, 334 function the same way in the embodiment of FIG. 13. One way-bearing 350 includes roller bearings 352, inner race 354, and outer race 356.

Inner race 354 is firmly connected to pivot shaft 336 and is formed to have a sawtooth shape, as shown. Outer race 356 is firmly connected to the pulley member 332, and is also formed in a sawtooth shape around the interior of pulley member 332. Roller bearings 352 are cylindrical roller bearings.

As shown, interior race 352 has sharp ramps 358, which present a steep drop-off in the sawtooth shape of race 354. Should pulley member 332 be rotated clockwise as viewed in FIG. 16, or in the direction of arrow 360, the ramps, such as ramp 362 of race 356, will wedge roller bearings 352 against the steep ramps 358, therefore causing the pulley member 332 to lock into registration or engagement with pivot shaft 336. As pulley member 332 is rotated in the direction of arrow 360, pivot shaft 336 is also so rotated. However, if pulley member 332 is rotated in the direction of arrow 364, roller bearings 352 do not engage with steep ramps 358, and pulley member 332 is allowed to "freewheel" with respect to pivot shaft 336. Thus, a one way clutch mechanism is achieved.

A clutch mechanism, such as that disclosed if FIG. 16 may also be employed in the association between the pedal means and the frame in various embodiments of an exercise apparatus of the invention. For example, the one way bearing 350 may be incorporated between pivot shaft 28 and rotating hub 62 and between pivot shaft 30 and rotating hub 64 of FIG. 1. Or one-way bearing 350 may be employed between rotating hub 257 and pivot shaft 258 and between rotating hub 261 and pivot shaft 262 of FIG. 10. Incorporating a one-way bearing between the first and second pedal means and the frame allows resistance to be felt in only one direction of the first and second pedal means. As stated earlier, it may be advantageous for resistance to be felt only when the pedal means is moved in the rearward direction to simulate, for example, the resistance felt by an exerciser when running or cross-country skiing.

Referring now to the embodiment of FIGS. 1 and 2, exercises may be performed by a user standing with his left foot upon ridged surface 57 of pedal 56 and his right foot upon ridged surface 61 of pedal 60. He would then preferably grasp hand grip 76 with his left hand and hand grip 80 with his right hand. In this position, the user would be standing facing in the direction of arrow 50.

With the apparatus in the position as shown generally in FIG. 1, the user may make a swinging motion with pedals 56 and 60, for example in the directions 50 or 52 with either of his feet. The preferable exercise performed on the embodiment of FIGS. 1 and 2 is one in which the user first swings one of his feet forward, in the direction of arrow 50, and the other foot rearward, in the direction of arrow 52. The user then reverses this motion and swings the pedal which has been swung forward in the rearward direction, and the pedal that has been swung rearward in the forward direction. The user thus continues to reciprocate the motion of pedals 56 and 60 in conjunction with the reciprocating motion of handled means 68 and 70.

The user may aid his legs in the swinging motion as described by exerting force either forward or rearward upon hand grips 76 or 80, respectively. The apparatus of FIG. 1 therefore also facilitates exercise of the user's arms and upper body while at the same time simulating generally a striding like motion. An exerciser engages in a striding-like motion when his legs, particularly his upper legs, reciprocate back and forth in a scissor fashion, such as, for example, the motion an exerciser engages in when walking, running, cross-country skiing, or swimming. When a person rides a bicycl or bicycle exerciser, the rotation of the feet throughout a 360° path and the pumping motion of the legs is not considered to be a striding-like motion. However, an exerciser or user may also engage in some degree of knee bending when performing striding exercises on the apparatus.

Other positions of the body with respect to the apparatus are possible. For example, the user may face in the direction of arrow 52, placing his left foot upon pedal 60 and his right foot upon pedal 56, his right hand upon handle means 68 and his left hand upon handle means 70 and perform a similar reciprocating motion, exercising different muscle groups than exercises performed in the direction previously discussed. Also, the user may stand on a support surface and place one foot on one of the support means to exercise the one foot or leg.

If the user desires to increase or decrease the resistance offered to the rotational or swinging action of the pedal means 34 and 36 and handle means 68 and 70, the user simply need rotate resistance means 110 and 112 in a clockwise or counter-clockwise direction. Resistance means 110 and 112 may be provided with a measuring mechanism by which the user may calibrate the amount of friction applied to the rotating motion of hubs 62 and 64. For example, resistance means 110 and 112 may be provided with an internal device that emits an audible clicking sound each time a predetermined amount of rotation is applied. Or, for example, hubs 26 and 20 may be provided with markings which register with a corresponding mark on resistance means 110 and 112 to indicate predetermined amounts of rotation of resistance means 110 and 112 with respect to hubs 26 and 20, respectively.

An advantageous feature of the resistance means as disclosed in the preferred embodiment shown in FIGS. 1 and 2 is that the first and second resistance means may be adjusted while the user is mounted on the apparatus. The user merely need rotate clockwise or counter-clockwise resistance means 110 or 112 to vary the resistance applied to rotational pivoting motion of the pedal means. Another advantageous feature is that the degree of resistance offered by the resistance means 110 or 112 may adjusted independently of one another. The user may thus achieve equal resistance or an unequal distribution of resistance. An unequal resistance may be advantageous in a situation where the user wishes to strengthen one arm and/or leg more than the other arm and/or leg. If, for example, the user has a weaker leg, for example as a result of an injury, this independent adjustment may allow him to use the exercise apparatus to strengthen the weak leg.

In the embodiment of FIGS. 6 and 7, the user would stand facing either in the direction of arrow 50 or arrow 52, placing his feet on foot supports 56 or 60, as previously discussed. However, the user would not grasp handles such as hand grips 76 and 80, of FIG. 1. The user may, however, balance himself upon foot supports 56 or 60 to effectuate the reciprocating action as previously discussed. Once the user begins effectuating such a reciprocating action with his legs, he may more easily keep his balance on the exercise apparatus. Or the user may grasp hubs 20, 22 and hubs 24, 26 to steady himself.

If the members which connect the pedal means to the journal means are approximately the same length or of greater length than the user's legs, it may be necessary to include some structure to preclude the pedals from swinging far enough apart to allow the user to over-extend his legs or "do the splits." A dog and notch structure, such as that illustrated in FIG. 4 may be employed. For example, rotating hubs 62 and 64 may be formed like frame hub 20 in FIG. 4, to have a dog such as dog 120. Frame hubs 22 and 24 may have corresponding notches, such as notch 118 to register with the dogs.

Or it may also be desirable to make the leg members or other members connecting the pedals to their pivoting axes to be shorter than the user's legs. If the connecting members are shorter than the user's legs, as the pedals swing away from each other in either direction, at some point a condition of equilibrium will be achieved. Beyond this equilibrium position, the user's weight will not allow the pedals to swing away from each other further, thus tending to greatly reduce the chance of the user "doing the splits." It is not necessary that all embodiments have a resistance mechanism. The weight of the user's body as he stands on the pedals tends to move the pedals to their equilibrium position, as previously discussed. The user's weight, therefore, may itself exert a certain resistance to moving the pedals from their equilibrium position.

It may be advantageous for certain embodiments to have a frame mounted sideways on a wall. The user may then lie on a flat surface and connect his feet to the pedals by a strap or other coupling device and then perform a scissor kick exercise, simulating for example, the scissor kick motion of the free style or back stroke swimming stroke.

Embodiments having universal joint associations of the pedal means to the frame may cause the user to exercise more leg muscles than he would if he were to simply engage in a forward and back swinging motion. For example, he may swing his legs slightly to the side, or in a somewhat circular or elliptical motion. Even when engaging in a simple forward and back swinging action such as described with respect to the embodiments of FIGS. 1 and 2, the user may tend to exert forces towards the insides or the outsides of his legs, thus exercising a broader range of muscles in the legs.

Preferable embodiments are those in which the pedal means are pivotally associated with the frame in such a way that the axes of rotation of the two pedal means are coaxial, much in the same way that the user's hip sockets have coaxial axes of rotation when the user engages in a striding-like motion. It may be particularly advantageous for the exercise apparatus of the invention to be configured such that the journal means or axes of rotation about which the pedal means rotate are adjacent or proximate the hips of the user.

Reference herein to details of the illustrated embodiment are not intended to restrict the scope of the claims, which themselves recite those features regarded as essential to the invention.

We claim:

1. An exercise machine comprising:

a frame having a first side spaced apart from a second side for supporting an upright user therebetween above a support surface, said frame including a first "U"-shaped member having a base member for positioning on the support surface and a second "U"-shaped member having a base member for positioning on the support surface, said first and second "U"-shaped members each having extension members mounted substantially normal to opposite ends of their respective bases;

first journal means and second journal means joined to said first and second sides respectively, said first and second journal means each having an axis of rotation positioned proximate the hips of an upright user, each of said extension members being rotatably joined to said first and second journal means for movement relative thereto between a first position for storage and a second position for exercise;

a first connection member and a second connection member joined to said first and second journal means respectively to rotate thereabout;

a first foot support and a second foot support joined to said first and second connection members respectively to support the feet of the user, said first and second foot supports extending from said axis of rotation at one end to its other end at the upright user's feet with means at the other end to support the feet of a user, said first and second foot supports being movable by the user's feet forwardly and rearwardly of the user through an arc in a striding-type movement;

first and second handle means joined to said first and second connection members respectively at said first and second journal means respectively to simultaneously rotate therewith, said first and second handle means being sized and positioned for grasping by the hands of the upright user; and resistance means for resisting pivotal movement of said first and second connection members.

2. The exercise apparatus of claim 1 wherein said first "U"-shaped member is sized with respect to said second "U"-shaped member to be closely proximate thereto in said first position for storage.

3. The exercise apparatus of claim 2 wherein said resistance means is comprised of:

a pair of first friction members one of each associated with each of said first and second connection members to rotate with said connection members;

a pair of second friction members connected to said frame and positioned to frictionally register with a respective first friction member to resist rotation of said first friction member relative to said frame; and adjustment means mechanically associated with said first and second friction members to vary the friction therebetween.

4. The exercise apparatus of claim 3 wherein the resistance means is a fluid resistance device associated with said frame and said first and second connection members.

5. The exercise apparatus of claim 3 wherein said axis of rotation of said first and second journal means are coaxial and wherein said first and second foot support means are rotatably mounted to said first and second connection means respectively.

6. The exercise apparatus of claim 3 wherein said adjustment means includes:

a bolt member associated with said first and second friction members, and having threads on a distal end; and a nut member rotatably in registration with said threads of said bolt member, said nut member being configured and adapted to vary normal force between said first and second friction members upon rotation of said nut member.

7. The exercise apparatus of claim 1 further comprising reciprocating means, including:

cable means associated with said first and second pedal means; and guide means for training said cable means in a path with respect to said cable means;

said cable means and said guide means being configured and adapted to force mutual reciprocating motion of first and second pedal means about said first and second journal means.

8. An exercise apparatus comprising:

a frame having a first side spaced apart from a second side for supporting an upright user between said first and second sides above a support surface;

first pedal means and second pedal means mounted to and suspended from said first side and second side respectively of said frame to rotate without contacting said support surface in a forward direction and a rearward direction through an arc about a pedal axis of rotation which is positioned proximate the hips of an upright user, said first and second pedal means being formed to extend from one end which rotates about said pedal axis of rotation to its other end at the feet of said upright user, said first and second pedal means each having foot support means affixed at said other end to support one foot of the upright user, said first and second pedal means with their respective foot support means each being rotatable forwardly and rearwardly about its respective pedal axis of rotation through said arc by movement to the upright user's feet forward and rearward of the user to stimulate a striding-type movement; and a reciprocating mechanism for causing reciprocating motion of said first and second pedal means with respect to said frame, said reciprocating mechanism including:

cable means in registration with said first and second pedal means for providing connective association between said first and second pedal means, guide means in registration with said cable means and mounted on said frame for training said cable means in a path with respect to said pedal means, said cable means and said guide means being configured and adapted to force said first and second pedal means to rotate in opposite directions about their respective pedal axes of rotation.

9. An exercise apparatus comprising a frame having a first side spaced apart from a second side for supporting an upright user between said first and second sides above a support surface;

first pedal means and second pedal means mounted to an suspended from said first side and second side respectively of said frame to rotate without contacting said support surface in a forward direction and a rearward direction through an arc about a pedal axis of rotation which is positioned proximate the hips of an upright user, said first and second pedal means being formed to extend from one end which rotates about said pedal axis of rotation to its other end at the feet of said upright user, said first and second pedal means each having foot support means affixed at said other end to support one foot of the upright user, said first and second pedal means with their respective foot support means each being rotatable forwardly and rearwardly about its respective pedal axis of rotation through said arc by movement of the upright user's feet forward and rearward of the user to simulate a striding-type movement;

a reciprocating mechanism for causing reciprocating motion of said first and second pedal means with respect to said frame, said reciprocating mechanism including:

cable means in registration with said first and second pedal means for providing connective association between said first and second pedal means, guide means in registration with said cable means and mounted on said frame for training said cable means in a path with respect to said pedal means, said cable means and said guide means being configured and adapted to force said first and second pedal means to rotate in opposite directions about their respective pedal axes of rotation; and resistance means connected to said frame and associated with said reciprocating mechanism to resist the pivotal reciprocating motion of said first and said second pedal means relative to said frame.

10. The exercise apparatus of claim 9, further Comprising a first handle means and a second handle means adapted to said first side and said second side respectively of said frame for grasping by the user positioned generally upright with one foot on each of said foot support means.

11. The exercise apparatus of claim 10 wherein said first and second handle means are each rotatably adapted to said first and second sides to rotate about a handle axis of rotation upon movement thereof by the user.

12. The exercise apparatus of claim 11 wherein said pedal axis and handle axis are the same and wherein said first and second handle means are each mechanically linked respectively to said first and second pedal means to pivotally move simultaneously with respect to said frame, and wherein said resistance means is associated with said cable means.

13. An exercise apparatus comprising:

a frame having a first side spaced apart from a second side for supporting an upright user between said first and second sides above a support surface;

first pedal means and second pedal means mounted to and suspended from said first side and second side respectively of said frame to rotate without contacting said support surface in a forward direction and a rearward direction through an arc about a pedal axis of rotation which is positioned proximate the hips of an upright user, said first and second pedal means being formed to extend from one end which rotates about said pedal axis of rotation to its other end at the feet of said upright user, said first and second pedal means each having foot support means affixed at said other end to support one foot of the upright user, said first and second pedal means with their respective foot support means each being rotatable forwardly and rearwardly about its respective pedal axis of rotation through said arc by movement of the upright user's feet forward and rearward of the user to simulate a striding-type movement;

resistance means associated with each of said first and second pedal means for resisting pivotal movement of said first pedal means and said second pedal means relative to said frame; and a reciprocating mechanism for causing reciprocating motion of said first and second pedal means with respect to said frame, said reciprocating mechanism including:

cable means in registration with said first and second pedal means for providing connective association between said first and second pedal means, guide means in registration with said cable means and mounted on said frame for training said cable means in a path with respect to said pedal means, said cable means being in non-slipping registration and endless-loop association between said first and second means to force said first and second pedal means to rotate in opposite directions.

* * * * *